United States Patent [19]

Walter et al.

[11] Patent Number: 4,896,772

[45] Date of Patent: Jan. 30, 1990

[54] COMPOSITE CONTAINER FOR FOOD AND PROCESS FOR ITS PRODUCTION

[75] Inventors: Juris Walter, Schaffhausen; Heinz Oster, Feuerthalen; Harald Severus, Schaffhausen, all of Switzerland

[73] Assignee: Swiss Aluminium, Ltd., Chippis, Switzerland

[21] Appl. No.: 192,826

[22] Filed: May 11, 1988

[30] Foreign Application Priority Data

May 12, 1987 [CH] Switzerland ..... 01807/87

[51] Int. Cl.[4] ..... B65D 85/72

[52] U.S. Cl. ..... 206/484.2; 206/524.2; 206/561

[58] Field of Search ..... 206/561, 524.2, 484.2

[56] References Cited

U.S. PATENT DOCUMENTS

| | | | |
|---|---|---|---|
| 3,866,820 | 2/1975 | Zumsteg . | |
| 4,116,336 | 9/1978 | Sorensen et al. | 206/524.2 X |
| 4,142,630 | 3/1979 | Hayes et al. | 206/524.2 X |
| 4,359,495 | 11/1982 | Schroeder et al. | 206/524.2 X |

*Primary Examiner*—Arnold Rosenthal
*Attorney, Agent, or Firm*—Bachman & LaPointe

[57] ABSTRACT

With a sterilizable composite container as preserving receptacle for food and other filled container products, which . . . by a simple tray or multi-compartment tray of plastic, receiving the filled product, a flexible or semi-rigid lid of a plastic/aluminium/plastic laminate, which is sealed by heat sealing to the border of the tray and any land, and a stretch formed trough of the same shape as the tray, which trough consists of flexible plastic-/aluminium/plastic laminate and surrounds, in close contact, the covered tray, the border of the trough being sealed on the lower part of the boarder of the tray by means of the action of temperature and pressure and/or, if appropriate, to the lid protruding beyond the border of the tray, the disadvantage affecting the known packs of flexible laminates for the same purposes of a low dimensional stability and their tendency to take on an unattractive appearance due to the formation of folds, in particular if the filled product is viscous or does not have any inherent stability, is voided.

14 Claims, 2 Drawing Sheets

COMPOSITE CONTAINER FOR FOOD AND PROCESS FOR ITS PRODUCTION

BACKGROUND OF THE INVENTION

The present inention relates to a sterilizable composite container as preserving receptacle for food and other filled products and a process for its production.

For the packing of convenience foods, in particular heat-sterilizable convenience foods in preserved form, one-piece containers, trays or multi-compartment trays of steel, aluminum, plastics or laminates of metal and plastic are used. The accompanying lids of these containers or trays are made in each case from the same material as the lower part or from one of the abovementioned materials, the connection of lid and container, tray or lower part taking place by mechanical flanging via a seal by welding or hot sealing.

For this application as long-term preserving pack for food, containers or trays of plastic have the disadvantage, due to the problem of gas permeability of plastics at elevated temperatures, here at temperatures of heat sterilization, of a very complex multi-layered wall consisting of barrier plastics, such as for example ethylene vinyl alcohol (EVAL), polyvinylidene chloride (PVDC), polyacrylates, nitrile plastics or special crystalline polyamides, between polypropylene or polyesters.

Such 0.5 mm–4 mm thick multi-layered constructions of plastics have the disadvantage of an involved, high-cost production process, in particular the shaping. They also have the disadvantage that a recycling of the production waste from the flat sheets and from the formed containers and trays is practically not possible.

Furthermore, these multi-layered plastic trays have to be covered with an aluminum/plastic laminate as only the aluminum ensures the shelf life of the filled product required for preserves of at least six months, due to its absolute barrier effect against the penetration of oxygen.

Flexible laminates from plastic/aluminum/plastic, for example in a thickness of 10–100 μm polyester laminated or coated with 10–100 μm aluminum and 10–100μm polyolefin (polypropylene or polyethylene), are shaped into trays or troughs by stretch forming. These troughs are filled with the foods and sealed with a lid strip of an analogous construction to that of the laminate of the tray, using a vacuum or inert gas flushing. After sterilization, these packs can be stored as preserving receptacles without refrigeration for up to two years.

These described packs of flexible laminates have the disadvantage of low dimensional stability and the tendancy to take on an unattractive appearance due to the formation of folds, in particular if the filled product is viscous or is not intrinsically stable. Furthermore, packs made of these flexible laminates cannot be multi-compartment trays since the intrinsic stability of the troughs is too low, because the laminate does not allow adequately steep partitions between the troughs due to the inferior formability.

The object of the present invention is to develop a composite container which does not have the disadvantages mentioned above and to specify a process for the production of such a composite container.

SUMMARY OF THE INVENTION

The foregoing object is achieved according to the invention by a composite container which is characterized by the features of claim 1 and by the process set out in claim 12. Further advantageous developments of the invention arise from the features of claims 2 to 11 as well as 13 and 14.

The composite container according to the invention consists of:

a tray of a single-layered plastic, a lid of a plastic/aluminum/plastic laminate, a trough of a plastic/aluminum/plastic laminate.

The tray of, for example, polyethylene, polypropylene, polyester, polyamide, may be designed as a simple tray or a multi-compartment tray. After filling of the tray and evacuation or gassing of the content, it is sealed by the border of the tray and the land between the compartments of the tray, in the case of the multi-compartment tray, by the action of heat. The plastic-/aluminum/plastic laminate of the trough is stretch-formed and surrounds the tray of plastic on the outside in close contact to a greater or lesser extent, and is sealed from below from its border against the border of the tray. In a further development, it can, furthermore, also be sealed with the lid extending beyond the border of the tray.

The composite container according to the invention is further characterized in that it is suitable for receiving filled products normally appropriate for domestic use of 50 to 1500 ml up to amounts suitable for catering of up to 5000 ml —in the form of prepared foods as several components of a menu which are accommodated in the individual compartments of the multi-compartment tray or as a single-component meal in a simple tray.

An advantageous further characteristic of the composite container is that, after heat sterilization of the filled product, it can be stored in the pack for at least two years without refrigeration and the content is ready to eat after quickly heating up in a water bath, a circulating air oven or in a microwave oven.

The production of the composite container described above takes place according to the invention in several steps; advantageously in a continuous forming, filling and sealing process, for example in the following way:

The plastic tray is thermoformed from a flat sheet of thermoplastic, for example polypropylene or polyester or polyamide or other of a thickness of 0.1–3 mm. Compressed air or a vacuum is used to press the heated sheet of plastic against a mould, so that after cooling, the plastic takes on the shape of the mould, whether a simple tray or a multi-compartment tray, of the intended filling volume.

These trays, continuously impressed one after the other into the sheet of plastic are filled with the food or foods, appropriately shaped cover masks being arranged over the trays in such a way that the filled product safely goes into each tray or its compartments, to avoid messing the tray borders.

Subsequently, the trays with filled products are evacuated or gassed with inert gas, for example nitrogen, and the lids are sealed on in the form of a continuously running off lid film of laminate - consisting of plastic sealing layer, facing the plastic tray with filled product, aluminum barrier layer and plastic layer - by pressure applied from the reverse or on top under the action of heat. Sealing is performed with corresponding electrically heated sealing tools under the action of pressure and temperature at the border and the land between the tray compartments on a level with the border of the plastic trays. The sheet of trays with covering can then be divided up into individual packs. However, further processing in sheet form is recommendable.

In a further process step, the filled pack consisting of plastic tray and laminate lid is then given a further packaging envelope of a flexible laminate of plastic/aluminum/plastic.

This further packaging wrapping is the reason for the term composite pack or composite container.

The plastic/aluminum/plastic laminate required for the packaging wrapping is stretch formed, running off a roll, by means of compressed air or a ram to give a trough. This trough corresponds in its contours to the plastic tray without formation of the land and is designed to be of such a volume that the plastic tray fits snugly into this trough.

After insertion of the pack formed by filled and covered plastic tray into the trough of laminate referred to above as packaging envelope, evacuation once again takes place and the trough is sealed by the action of heat and pressure to the lower border of the plastic tray and, if appropriate, to the lid of laminate protruding beyond the plastic tray.

Subsequently, the packs arranged in rows in the sheet are divided up into individual packs and heat-sterilized in back pressure autoclaves.

As an advantageous further development of the composite pack according to the invention, protuberances are formed on the appropriately vertical walls of the multi-compartment tray, connected by land, in such a way that either the protuberances of neighbouring walls lie against each other or protuberances of one wall touch or approximately touch the neighbouring wall.

Such a multi-compartment tray has, on the one hand, the advantage that it scarcely deforms, in particular after receiving the filled product, and thus facilitates the subsequent sealing operations, and on the other hand promotes the stability of the composite container as a preserving receptacle, and also prevents the bending of the same, which benefits the aesthetic appearance of the composite container.

Furthermore, to improve the stability, both in use of the simple tray and of the multi-compartment tray, with or without protuberances, a stiff base in plate form can be arranged between the tray and the trough. In the simplest case of handling, the base, which may consist of the same material as the tray, is laid in the trough before the tray which follows. At the borders, the base may, at least in some places, be assigned flanking parts which lie against the walls of the trough and thereby contribute to further stability and/or positioning of the base. The base may also be fixed, for example, by adhesion, either to the trough or, in particular, to the tray.

BRIEF DESCRIPTION OF THE DRAWINGS

In a further development of the invention, instead of the protuberances mentioned above in the case of the multi-compartment trays, with the same advantageous effect, inserts can be pushed between neighbouring walls as spacers, which consist in particular of the same plastic as the tray.

DETAILED DESCRIPTION

Figure 1:
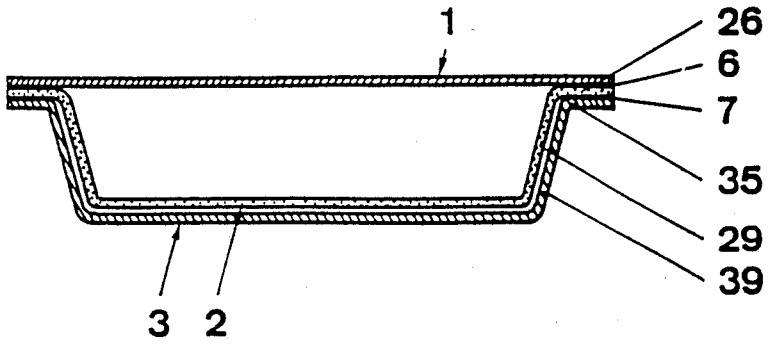
FIG. 1 is a sectional view of the composite container of the present invention.
Figure 2:
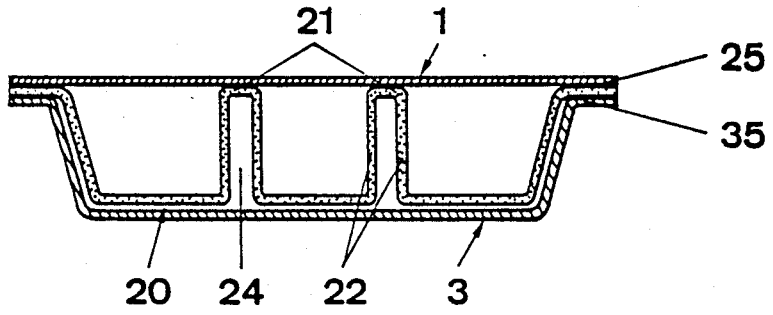
FIG. 2 is a sectional view of the composite container of the present invention which is divided into multi-compartments.
Figure 3:
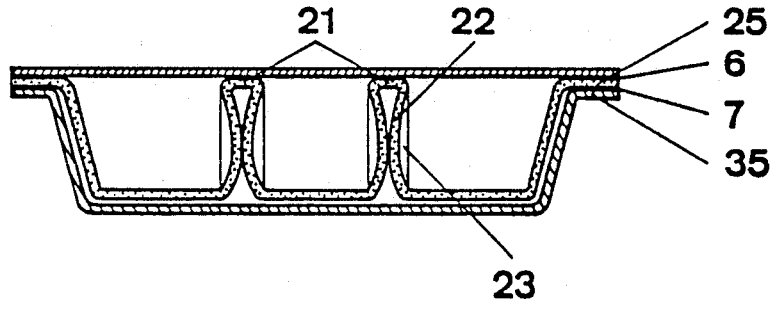
FIG. 3 is a second embodiment of the composite container of the present invention which is divided into multi-compartments.
Figure 4:
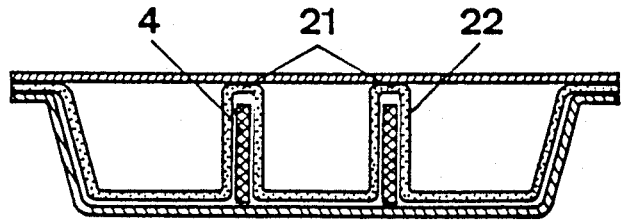
FIG. 4 is a third embodiment of the composite container of the present invention which is divided into multi-compartments.
Figure 5:
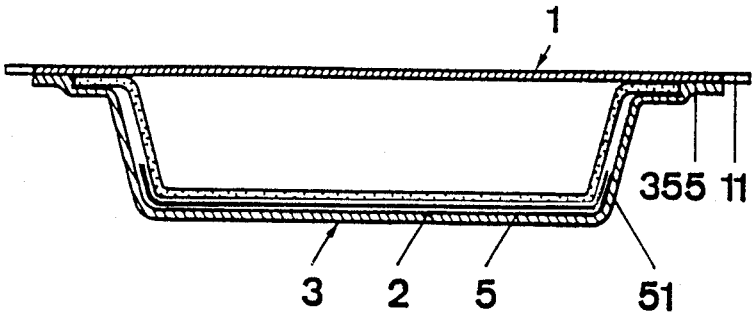
FIG. 5 is a fourth embodiment of a composite container of the present invention employing a stiffening base.
Figure 6:
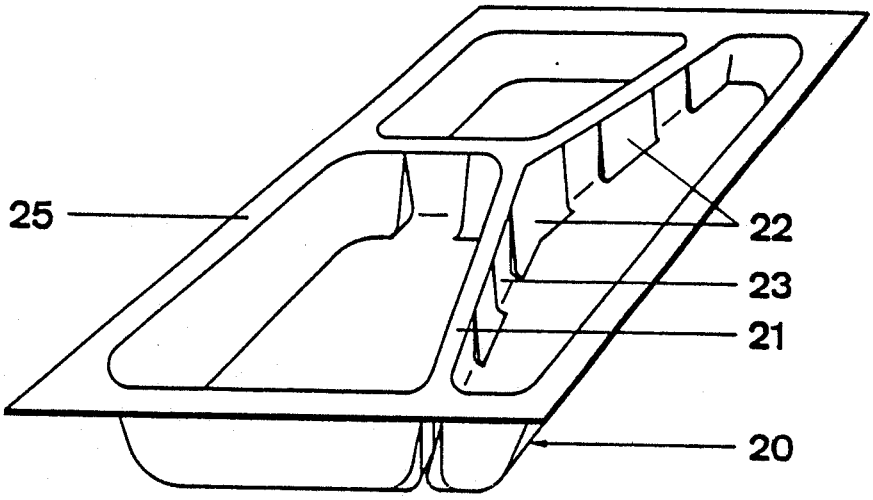
FIG. 6 is a perspective view of a multi-compartment container in accordance with the present invention.
Figure 7:
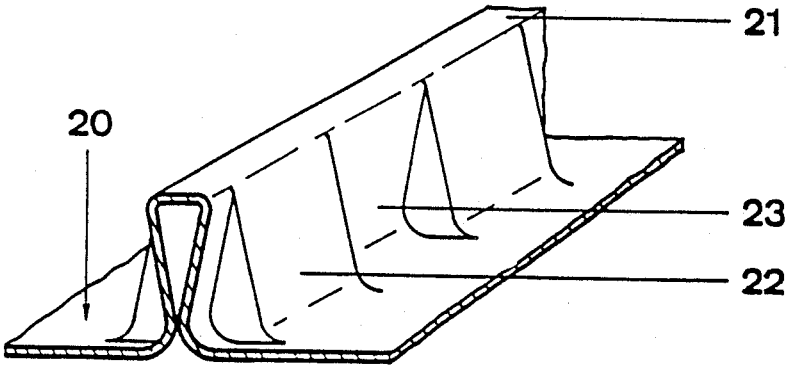
FIG. 7 is a partial sectional view showing one embodiment of a wall for dividing the container of the present invention into multiple compartments.

The composite container according to the invention is explained with reference to the drawing. In FIGS. 1 to 5, various developments of the composite containers are shown diagrammatically in cross-section; FIGS. 6 and 7 show in angled perspective a tray with protuberances, as a whole and in an enlarged partial view.

The composite container according to the invention consists of a tray 2 or 20 with flanks 29, a trough 3 with flanks 39 and a lid 1, the border 25 of the tray 2 or 20 and the lid 1 being connected to each other by a sealed seam 6 and these two in turn by a second sealed seam 7 to the border 35 of the trough 3 and/or, if appropriate, to the lid 1 protruding beyond the border 25 or 26 of the tray 2 or 20.

A multi-compartment tray 20 has walls connected by land 21, which may be provided with protuberances 23. The protuberances 23 of neighbouring walls 22 touch or are arranged so close together that they restrict or completely prevent a deformation of the border 26 of the tray 20. An analogous change in the deformation of multi-compartment trays 20 can be effected by the multi-compartment tray 20 having inserts 4 as spacers in the slit 24 formed by neighbouring walls 22 and land 21.

In a further development of the composite container according to the invention, to improve the stability both with use of the simple tray 2 and of the multi-compartment tray 20, with or without protuberances 23, a stiff base 5 in plate form is arranged between the tray 2 or 20 and the trough 3. The base 5 may have at the borders, at least in some places, flanking parts 51 which lie against the walls of the trough 3 and/or tray 2 or 20 and thereby effect an additional stability. At the same time, the flanking parts 51 serve the positioning of the base 5. Alternatively, or additionally, the base 5 may also be fixed to the trough 3 or to the tray 2, or in particular to the multi-compartment tray 20, with the consequence that, with fixing to the multi-compartment tray 20 in particular, the stability of the same is increased and, with fixing to the tray 2 or to the trough 3, the overall stability of the composite container is promoted, which benefits the aesthetic appearance.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A sterilizable composite container comprising:

(a) a trough formed from a flexible plastic-/aluminum/plastic laminate, said trough having a base portion, a sidewall portion extending from said base portion and a lip portion extending from said sidewall portion wherein said base portion and said sidewall portion define a compartment;

(b) a tray formed from a plastic material located in said compartment wherein said tray has a base portion, sidewall portion and lip portion defining a storage compartment wherein the lip portion of said tray rests on the lip portion of said trough; and (c) a lid formed from a flexible plastic/aluminum/-plastic laminate which rests at least on said lip portion of said tray wherein said lid is heat sealed to said tray and said tray is heat sealed to said trough wherein said lid is flush with the lip portion of the tray and is provided with a part protruding beyond the lip portion of the tray as a tear-open tab.

2. A composite container according to claim 1 wherein the tray is formed from a thermopalstic material selected from the group consisting of polypropylene, polyethylene terephthalate, polybutyleneterephthalate, polycarbonate, polyamide, polyphenylene oxide, polyethylene sulphone, polyimide, polyether ether ketone, their copolymers and mixtures thereof and has a thickness of between 0.1–3 mm.

3. A composite container according to claim 2 characterized in that the tray storage compartment has a filling volume of 0.05 to 5 liters, and said tray has at least one wall for subdividing said compartment, said wall having a strip of land heat sealed to said lid.

4. A composite container according to claim 3 wherein said at least one wall is in the shape of an inverted U having side legs connected by said strip by land thereby defining a slit.

5. A composite container according to claim 1 wherein the lip portion of said tray is 1 to 20 mm in width.

6. A composite container according to claim 4 wherein the side legs project toward each other in the region of the slit.

7. A composite container according to claim 4 wherein an insert is provided in the slit.

8. A composite container according to claim 1 wherein a stiff base in the form of a plate is located between the tray and the trough.

9. A composite container according to claim 1 wherein the configuration of the tray is substantially similar to that of the trough.

10. A composite container according to claim 1 wherein the lid fitted onto the tray by heat sealing consists of layers of plastic and aluminum which each have a thickness of 5–100 μm.

11. A composite container according to claim 1 wherein the plastic/aluminum/plastic laminate of the lid and the plastic/aluminum/plastic laminate forming the trough have on the side facing the tray a heat-sealing layer suitable for heat sealing against the plastic of the tray and against each other.

12. A composite container according to claim 1 wherein the trough is free from folds and lies closely against the tray and lends the filled product a protection against the access of gas and moisture, loss of aroma and incidence of light.

13. A sterilizable composite container comprising:

(a) a trough formed from a flexible plastic-/aluminum/plastic laminate, said trough having a base portion, a sidewall portion extending from said base portion and a lip portion extending from said sidewall portion wherein said base portion and said sidewall portion define a compartment;

(b) a tray formed from a plastic material located in said compartment wherein said tray has a base portion, sidewall portion and lip portion defining a storage compartment wherein the lip portion of said tray rests on the lip portion of said trough, said tray further comprising at least one wall for subdividing said compartment, said at least one wall being substantially an inverted U-shape having side legs connected by a strip by land thereby defining a slit and an insert provided in said slit; and (c) a lid formed from a flexible plastic/aluminum/-plastic laminate which rests at least on said lip portion of said tray wherein said lid is heat sealed to said tray and said tray is heat sealed to said trough.

14. A sterilizable composite container comprising:

(a) a trough formed from a flexible plastic-/aluminum/plastic laminate, said trough having a base portion, a sidewall portion extending from said base portion and a lip portion extending from said sidewall portion wherein said base portion and said sidewall portion define a compartment;

(b) a tray formed from a plastic material located in said compartment wherein said tray has a base portion, sidewall portion and lip portion defining a storage compartment wherein the lip portion of said tray rests on the lip portion of said trough wherein a stiff base in the form of a plate is located between the tray and the trough; and (c) a lid formed from a flexible plastic/aluminum/-plastic laminate which rests at least on said lip portion of said tray wherein said lid is heat sealed to said tray and said tray is heat sealed to said trough.

* * * * *